US006113363A

United States Patent [19]

Talaski

[11] Patent Number: 6,113,363

[45] Date of Patent: Sep. 5, 2000

[54] TURBINE FUEL PUMP

[75] Inventor: Edward J. Talaski, Caro, Mich.

[73] Assignee: Walbro Corporation, Cass City, Mich.

[21] Appl. No.: 09/251,382

[22] Filed: Feb. 17, 1999

[51] Int. Cl.[7] ..... F04B 17/00; F04B 35/04

[52] U.S. Cl. ..... 417/423.3; 415/55.1

[58] Field of Search ..... 415/55.1, 55.4; 417/423.3, 435, 203, 423.1

[56] References Cited

U.S. PATENT DOCUMENTS

| | | | |
|---|---|---|---|
| 5,011,369 | 4/1991 | Mine et al. | 415/55.1 |
| 5,129,796 | 7/1992 | Emmert et al. | 417/435 |
| 5,209,630 | 5/1993 | Roth | 415/55.1 |
| 5,257,916 | 11/1993 | Tuckey | 417/423.3 |
| 5,273,394 | 12/1993 | Samuel | 415/55.1 |
| 5,348,442 | 9/1994 | Harris et al. | 415/55.1 |
| 5,372,475 | 12/1994 | Kato et al. | 415/55.1 |
| 5,393,203 | 2/1995 | Hantle | 417/203 |
| 5,407,318 | 4/1995 | Ito et al. | 415/55.1 |
| 5,409,357 | 4/1995 | Yu et al. | 417/423.1 |
| 5,509,778 | 4/1996 | Hantle et al. | 415/55.1 |
| 5,513,950 | 5/1996 | Yu | 415/55.1 |
| 5,527,149 | 6/1996 | Moss et al. | 415/55.1 |
| 5,549,446 | 8/1996 | Gaston et al. | 415/55.1 |
| 5,580,213 | 12/1996 | Woodward et al. | 415/55.1 |
| 5,586,858 | 12/1996 | Tuckey | 415/55.1 |
| 5,599,163 | 2/1997 | Heath et al. | 415/55.1 |
| 5,607,283 | 3/1997 | Kato et al. | 415/55.1 |
| 5,642,981 | 7/1997 | Kato et al. | 415/55.1 |
| 5,702,229 | 12/1997 | Moss et al. | 415/55.4 |
| 5,716,191 | 2/1998 | Ito et al. | 415/55.4 |
| 5,762,469 | 6/1998 | Yu | 415/55.1 |

FOREIGN PATENT DOCUMENTS 9624769 8/1996 WIPO .

*Primary Examiner*—Teresa Walberg
*Assistant Examiner*—Leonid Fastovsky
*Attorney, Agent, or Firm*—Reising, Ethington, Barnes, Kisselle, Learman & McCulloch, P.C.

[57] ABSTRACT

An electric motor turbine-type fuel pump having an impeller with a plurality of circumferentially spaced vanes disposed about the periphery of the impeller with each vane being inclined relative to a plane defined by the axis of rotation of the impeller and a radius of the impeller extending to a leading face of that vane with the leading face of each vane having a generally concave or cup shape. The vanes have a base connected to a main body of the impeller and a free end or tip radially outwardly of the base. Preferably, the vanes are inclined such that the tip trails the base as the impeller rotates and are generally arcuate along both their axial and radial extent. This orientation of the vane and the concave or cup shape of each vane improves the circulation of the fuel about the periphery of the impeller to improve the efficiency of the fuel pump. More specifically, the inclined or canting of the vanes is believed to improve the flow of fuel into a pocket defined between adjacent vanes and the concave or cup shape of the vanes is believed to help direct the fuel discharged from the pocket forward relative to the direction of rotation of the impeller.

12 Claims, 3 Drawing Sheets

TURBINE FUEL PUMP

FIELD OF THE INVENTION

This invention relates generally to a fuel pump and more particularly to a regenerative or turbine type fuel pump.

BACKGROUND OF THE INVENTION

Electric motor fuel pumps have been widely used to supply the fuel demand for an operating engine such as in automotive applications. These pumps may be mounted directly within a fuel supply tank with an inlet for drawing liquid fuel from the surrounding tank and an outlet for delivering fuel under pressure to the engine. The electric motor includes a rotor mounted for rotation within a stator in a housing and connected to a source of electrical power for driving the rotor about its axis of rotation. In the pump, an impeller is coupled to the rotor for corotation with the rotor and has a circumferential array of vanes about the periphery of the impeller. One example of a turbine fuel pump of this type is illustrated in U.S. Pat. No. 5,257,916.

Previous fuel pump impellers have vanes which are generally flat, straight and radially outwardly extending. Other impeller vanes have been flat, straight and canted relative to a radius of the impeller. With this general configuration, previous fuel pumps have had an overall efficiency of approximately 20% to 35% and when combined with an electric motor having a 45% to 50% efficiency, the overall efficiency of such electric motor turbine-type fuel pumps is between about 10% to 16%. Thus, there is the continuing need to improve the design and construction of such fuel pumps to increase their efficiency.

SUMMARY OF THE INVENTION

An electric motor turbine-type fuel pump having an impeller with a plurality of circumferentially spaced vanes disposed about the periphery of the impeller with each vane being inclined relative to a plane defined by the axis of rotation of the impeller and a radius of the impeller extending to a leading face of that vane with the leading face of each vane having a generally concave or cup shape. The vanes have a base connected to a main body of the impeller and a free end or tip opposite the base. Preferably, the vanes are inclined such that the tip trails the base as the impeller rotates and are generally arcuate along both their axial and radial extent. This orientation of the vane and the concave or cup shape of each vane improves the circulation of the fuel about the periphery of the impeller to improve the efficiency of the fuel pump. More specifically, the inclined or canting of the vanes is believed to improve the flow of fuel into a pocket defined between adjacent vanes and the concave or cup shape of the vanes is believed to help direct the fuel discharged from the pocket forward relative to the rotation of the impeller.

Objects, features and advantages of this invention include providing an improved impeller for a turbine-type fuel pump which improves the efficiency of the fuel pump, improves the circulation of fuel through a pumping channel defined about the periphery of the impeller, can be used with existing fuel pump designs, has improved hot fuel handling performance, is rugged, durable, of relatively simple design and economical manufacture and assembly and has a long useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
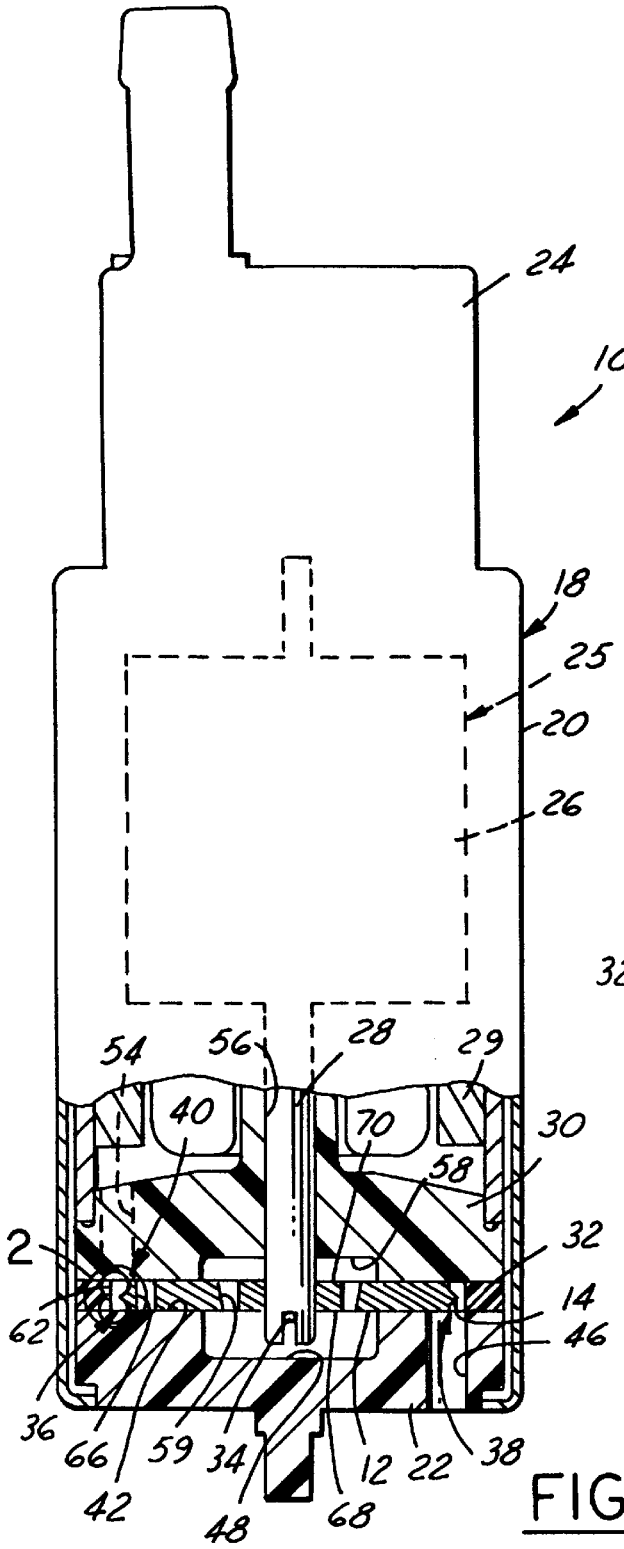
FIG. 1 is a side view with portions broken away and in section of an electric motor turbine-type fuel pump having an impeller embodying the present invention.
Figure 2:
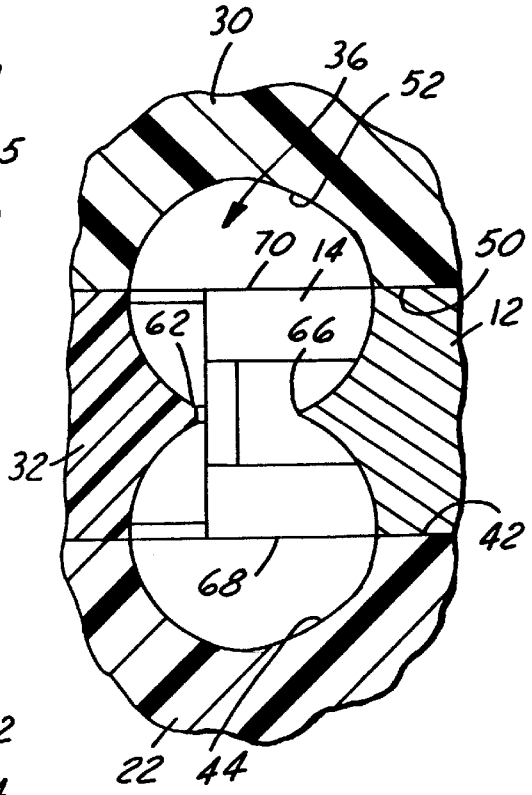
FIG. 2 is a fragmentary sectional view of the encircled portion 2 of the fuel pump of FIG. 1.

Referring in more detail to the drawings, FIGS. 1 and 2 illustrate an electric motor turbine-type fuel pump 10 having a circular impeller 12 embodying the present invention with a circumferential array of vanes 14 each generally canted or inclined at an acute included angle relative to a radius of the impeller 12 and having a generally concave or cup-shaped leading face 16. The fuel pump 10 has a housing 18 formed by a cylindrical case 20 that joins axially spaced inlet 22 and outlet 24 end caps. The impeller is driven by an electric motor 25 having a rotor 26 journalled by a shaft 28 for rotation within a surrounding permanent magnet stator 29 both received in the housing 18. The rotor 26 is coupled to the impeller 12 which is disposed between the inlet end cap 22 and an upper pump body 30 and within a ring 32 encircling the impeller. The impeller 12 is coupled to the shaft 28 by a wire clip 34 for corotation with the shaft 28. An arcuate pumping channel 36 is defined about the periphery of the impeller 12 by the inlet end cap 22, upper pump body 30 and the ring 32. The pumping channel 36 has an inlet port 38 into which fuel is drawn and an outlet port 40 through which fuel is discharged into the housing 18 under pressure. With the exception of the impeller 12, the fuel pump 10 is preferably constructed as disclosed in U.S. Pat. No. 5,586,858, the disclosure of which is incorporated herein by reference in its entirety.

The inlet end cap 22 has a flat upper face 42 and an arcuate groove 44 formed therein which defines in part the pumping channel 36. An inlet passage 46 through the inlet end cap 22 communicates with the inlet port 38 of the pumping channel 36. A central blind bore 48 provides clearance for the shaft 28 and clip 34.

The upper pump body 30 has a flat lower face 50 adjacent the impeller 12 and an arcuate groove 52 formed therein defining in part the pumping channel 36. An outlet passage 54 through the body communicates the outlet port 40 of the pumping channel 36 with the interior of the housing 18. A central through bore 56 receives the shaft 28 and a counterbore 58 provides clearance for the clip 34 which may extend through holes 59 in the impeller 12. The holes 59 also equalize the pressure across the impeller within the bore 48 and counterbore 58.

The ring 32 is clamped between the inlet end cap 22 and the upper pump body 30. The ring 32 has a centrally disposed and radially inwardly extending rib 62 spanning a substantial arcuate extent of the impeller 12 between the inlet and outlet of the channel.

As best shown in FIGS. 3–7, the impeller 12 has a disc body 63 with a central hole 64 through which the shaft 20 is received, a circumferential array of angularly spaced and generally radially and axially extending vanes 14 and a radially extending rib 66 centered between opposed axial faces 68, 70 of the impeller 12 and spaced radially inwardly from the radially outermost portion of the vanes 14. In the preferred embodiment of the invention the impeller vanes 14 are so-called open pocket vanes in which a single pocket 72 defined between adjacent vanes 14 communicates with the channel 36 and both grooves 44, 52 of the inlet end cap 22 and the upper pump body 30, respectively. However, so-called closed vane constructions in which the rib 64 of the ring 32 extends radially to the periphery of the impeller and bisects the pocket 72 into two separate pockets may also be employed.

Figure 7:
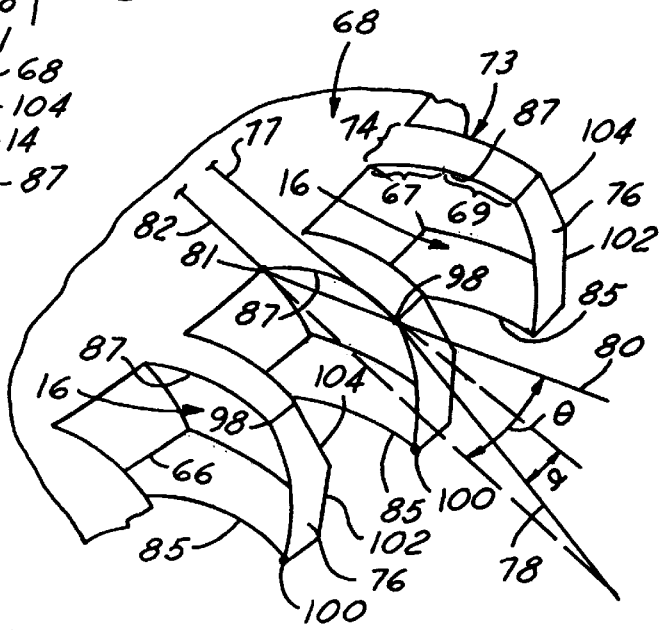
FIG. 7 is a fragmentary view of the encircled portion 7 of FIG. 3.
Figure 8:
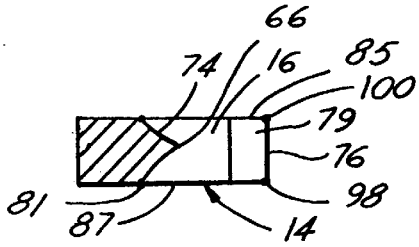
FIG. 8 is a sectional view taken along line 8—8 of FIG. 4.

Each vane 14 has an axially extending leading or front face 16, a trailing face 73, a base portion 74 operably connected to and preferably integral with the impeller 63 and a free end or tip 76 extending into the pumping channel 36. The vanes 14 do not extend from the body 63 in a straight radial direction. Rather, the vanes 14 are preferably inclined at an acute included angle relative to a plane 65 (FIG. 3) defined by the axis of rotation 89 of the impeller 12 and a radius 82 of the impeller 12 extending to a point 81 on an axial edge 85 of the leading face at the base 74 of the vane 14 such that, along at least the leading face 16, the tip 76 trails or lags behind the base 74 of its vane 14 as the impeller 12 rotates. In other words, along the leading face 16 of each vane 14, the tip 76 is located circumferentially spaced from and behind the base 74 of the vane 14 relative to the direction of rotation of the impeller 12, which is clockwise as viewed in FIG. 4 as indicated by arrow 75. Nominally, in one embodiment having vanes about 1.25 mm in length, the tip trails the base by about 0.2 mm. As shown in FIGS. 4 and 7, an angle θ at which a vane 14 is inclined is measured between: 1) a line 80 connecting a point 81 on the leading face at the base 74 and a point 98 on the leading face at the tip 76; and 2) a radius 82 of the impeller 12 extending through point 81 on the leading face at the base 74 of that vane 14. Preferably, the vanes 14 are each inclined at an angle θ of approximately 10° to 20°.

To direct the fuel discharged from a pocket 72 forward (in the direction of rotation) in the pumping channel 36 towards the outlet port 40, the base 74 and the tip 76 of each vane 14 lead or are located circumferentially forward of a mid-portion of the vane 14 disposed radially between the base 74 and the tip 76. Thus, as shown in FIGS. 4 and 7, a portion 67 of the vane 14 generally radially outboard of the base 74 is inclined circumferentially away from the plane 65 and trails the base 74 as the impeller rotates. An inclined radially outer portion 79 of the vane 14 which includes the tip 76 and extends from the portion 67 is inclined or curved towards the plane 65 but trails the plane 65 as the impeller rotates. Preferably, the vanes are generally arcuate along their generally radial extent although portions 67 and 79 may be generally planar or of some other shape. The inclined radially outer portion 79 defines a so-called exit angle α at which fuel is directed from the vane 14. As shown in FIGS. 4 and 7, the exit angle α of the vane 14 is defined between a radius 77 of the impeller 12 extending to the point 98 on the tip 76 at its leading face 16 and a line 78 extending from the leading face 16 of the tip 76 generally parallel to the axial edge of the angled radially outer portion 79. The exit angle α is desirably between about 0° and 35° and preferably, between about 10° and 30°.

Figure 3:
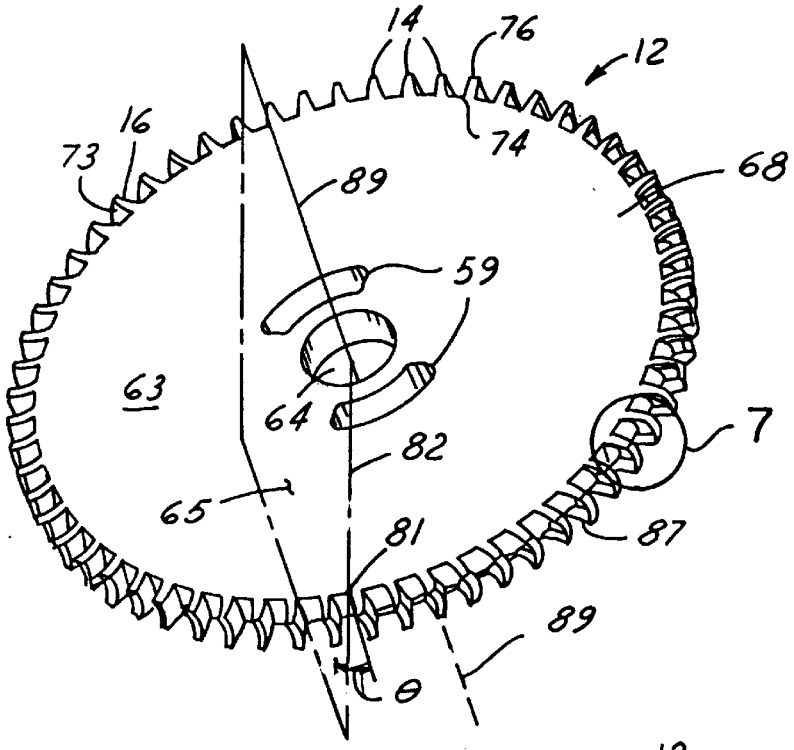
FIG. 3 is a perspective view of the impeller of FIG. 1.
Figure 4:
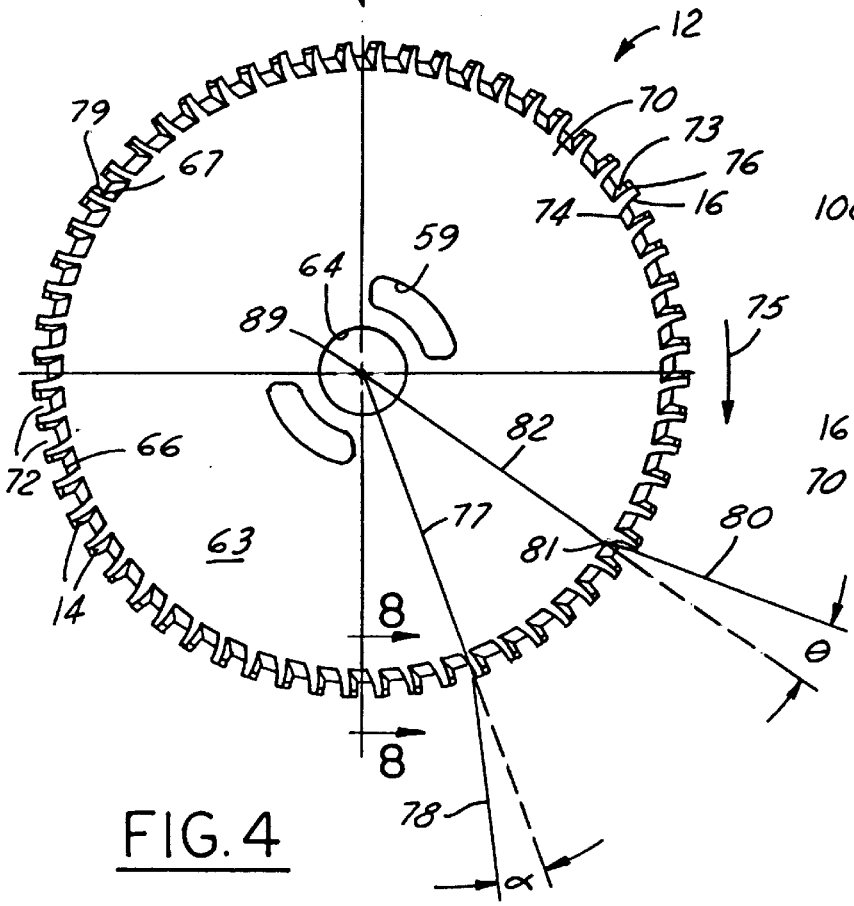
FIG. 4 is a plan view of the impeller.
Figure 5:
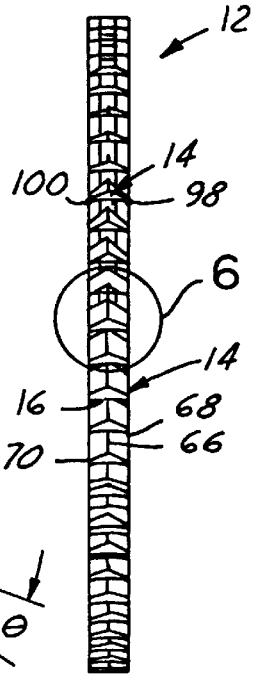
FIG. 5 is an end view of the impeller.
Figure 6:
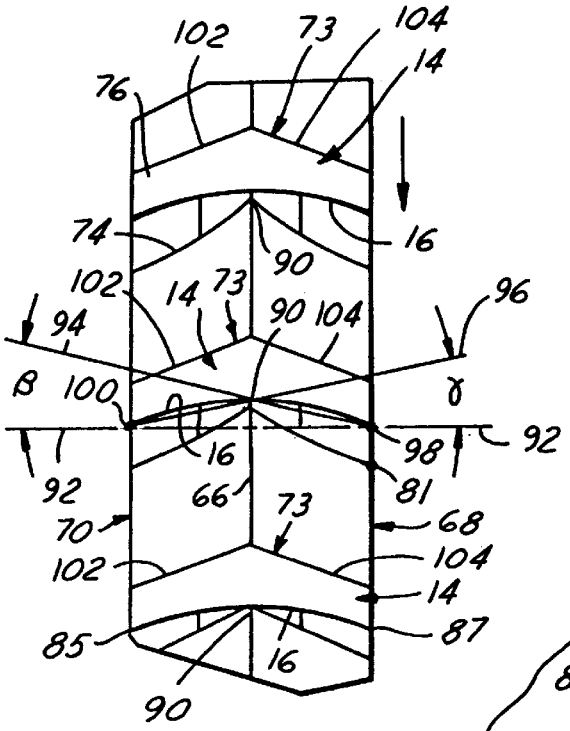
FIG. 6 is a fragmentary end view of the encircled portion 6 of FIG. 5.

In the preferred embodiment, as shown in FIGS. 3, 5 and 6, each vane 14 is also generally curved or arcuate along its axial extent. Thus, at least along the leading face 16 of each vane 14, the axial edges 85 and 87 lead at least a mid-portion of the vane 14 disposed between the axial edges 85 and 87 relative to the direction of rotation of the impeller 12. Nominally, a point 90 on the vane 14 generally midway between its axial edges 85 and 87 is circumferentially spaced from and trails its axial edges 85,87 relative to the direction of rotation of the impeller 12. As shown in FIG. 6, an angle β is defined between a line 92 interconnecting two points 98,100 on opposed edges 85,87 of a vane and a line 94 interconnecting the point 90 and the point 98 on edge 87 (with all three points, 98,90,100 being the same radial distance from the axis 89 of rotation of the impeller 12). An angle γ is defined between the line 92 and a line 96 interconnecting the point 90 and the point 100 on edge 85. Preferably, angles β and γ are equal such that a line parallel to the axis of rotation of the impeller 12 (such as line 92) may be drawn which intersects both of the points 98 and 100. Desirably, the angles β and γ are between about −5° and 10° and, preferably, between about 0° and 5°.

Thus, each vane 14 of the impeller 12 is: 1) generally inclined such that its tip 76 trails its base 74 as the impeller rotates (as generally indicated by angle θ); 2) non-planar and preferably generally arcuate along the radial extent of at least the leading face 76, as defined by portions 67 and 79 of the vane; and 3) non-planar and preferably generally arcuate along the axial extent of at least the leading face 16 (as generally indicated by angles β and γ). Preferably, the trailing face 73 of each vane 14 is generally complimentary shaped to the leading face 16, although, for ease of molding or other considerations, slight variances may be desirable between the leading face 16 and trailing face 73, such as the trailing face being in two planar segments 102 and 104 (FIG. 6) and defining an included angle of less than 180°.

In operation, as the rotor 26 drives the impeller 12 for rotation within the pumping channel 36, liquid fuel is drawn into the inlet port 38 of the pumping channel 36 whereupon it is moved around the pumping channel 36 and is discharged under pressure through the outlet port 40. The pressure of the fuel is increased which is believed to be due to a vortex-like pumping action imparted to the liquid fuel by the impeller 12. The liquid fuel enters the pockets 72 between adjacent vanes 14 of the impeller 12 both axially, such as from the grooves 44, 52 formed in both the inlet end cap 22 and the upper pump body 30, and radially, from between the impeller 12 and the ring 32. Canting or inclining the vanes 14 at an angle θ relative to a radius of the impeller 12 such that their tips 76 trail their associated bases 74 is believed to increase the volume of fuel captured within a pocket 72 as the impeller 12 rotates to increase the efficiency of the fuel pumping mechanism. Also, the canting or inclining of the vanes 14 at an angle θ such that the tip 76 of each vane 14 trails its base 74 tends to move the liquid fuel within a pocket 72 radially outwardly which improves the circulation of the liquid fuel through the pumping channel 36 to increase the fuel flow rate delivered from the fuel pump 10. Further, the non-planar and preferably generally arcuate shape of the vanes 14 along both the generally radial and axial extents of the vanes 14 provides a cup-shaped or generally concave vane to direct the liquid fuel discharged from a pocket 72 forward relative to the rotation of the impeller 12 so that the fluid leaves the pocket 72 at an increased speed in the direction of rotation of the impeller 12.

With this improved impeller 12 construction, the overall efficiency and hot fuel handling capability of the fuel pump 10 is increased. Empirical data and analysis has shown an improvement in overall efficiency of the fuel pump 10 by about 10% to 15% and of the electric motor and pump combination of 10% to 15%.

What is claimed is:

1. An impeller for a turbine type pump comprising:

a circular impeller body constructed to rotate about an axis and having a pair of generally axially opposed faces;

a plurality of circumferentially spaced vanes extending from the periphery of the impeller body, each having a base portion adjacent the impeller body, a tip radially outward of the base and an axially extending leading face having a pair of generally axially opposed edges, each vane is generally inclined at an acute included angle relative to a plane defined by the axis of rotation of the impeller and a radius of the impeller including a point on an axial edge of the leading face at the base of the vane such that the leading face of the tip of the vane is circumferentially spaced from and trailing the leading face at the base of that vane relative to the direction of rotation of the impeller body, at least a portion of the leading face of each vane located radially inwardly of the tip of the vane is disposed circumferentially spaced from and trailing the leading face of the tip relative to the direction of rotation of the impeller body, and at least a portion of the leading face of each vane between the axially opposed edges of the leading face is circumferentially spaced from and trailing the axially opposed edges of the leading face of its vane.

2. The impeller of claim 1 wherein an angle θ is defined between said plane and a line interconnecting said point on an axial edge of the leading face at the base of the vane and a point on said axial edge of the leading face at the tip of that vane, said angle θ being between about 10° to 20°.

3. The impeller of claim 1 wherein the leading face of each vane has a generally arcuate shape along its radial extent.

4. The impeller of claim 1 wherein each vane also has an axially and radially extending outer end portion including the tip and inclined relative to an immediately adjacent radially inward portion of the vane to lead the immediately adjacent radially inward portion of the vane in the direction of rotation of the impeller.

5. The impeller of claim 4 wherein the outer end portion is inclined at an acute included angle of about 0° to 35° relative to a radius of the impeller body extending to the leading face of the tip of that vane.

6. The impeller of claim 1 wherein along at least the leading face, each vane is generally arcuate along its axial extent.

7. The impeller of claim 1 wherein each vane has an axially extending trailing face defined by two generally planar segments which define an included angle of less than 180°.

8. An electric motor turbine type fuel pump comprising:

a housing having an inlet through which fuel is drawn, an outlet through which fuel is discharged under pressure and a fuel pumping channel communicating with the inlet and the outlet;

an electric motor including a rotor journalled for rotation within the housing; and an impeller coupled to the rotor for co-rotation therewith and having a circumferential array of vanes extending generally radially from the impeller into the fuel pumping channel, each vane has a base, a tip radially outwardly of the base and an axially extending leading face having a pair of generally axially opposed edges and each vane is generally inclined at an acute included angle relative to a radius of the impeller extending generally to the leading face at its base such that, along the leading face of a vane, the tip of the vane is circumferentially spaced from and behind the base relative to the direction of rotation of the impeller, at least a portion of the leading face of each vane between the base and the tip of the vane is disposed circumferentially spaced from and behind the tip at its leading face relative to the direction of rotation of the impeller, and at least a portion of the leading face of each vane disposed between the axially opposed edges of the leading face is circumferentially spaced from and behind the axially opposed edges of the leading face relative to the direction of rotation of the impeller to provide generally cup-shaped vanes whereby, the electric motor drives the rotor for rotation which in turn drives the impeller for rotation to draw fuel into the inlet, increase the pressure of the fuel in the fuel pumping channel and then discharge the fuel under pressure through the outlet.

9. The fuel pump of claim 8 wherein an angle θ is defined between a radius of the impeller body extending to a point on an edge of the leading face at the base of a vane and a line interconnecting said point and a point on said edge of the leading face at the tip of that vane, said angle θ being between about 10° to 20°.

10. The fuel pump of claim 8 wherein the leading face of each vane has a generally arcuate shape along its radial extent.

11. The fuel pump of claim 8 wherein the leading face of each vane has a generally arcuate shape along its axial extent.

12. The impeller of claim 4 wherein the outer end portion is inclined at an acute included angle of about 10° to 30° relative to a radius of the impeller body extending to the leading face of the tip of that vane.

* * * * *